US008022793B2

(12) United States Patent
Olson et al.

(10) Patent No.: US 8,022,793 B2
(45) Date of Patent: Sep. 20, 2011

(54) SANDWICH VEHICLE STRUCTURE HAVING INTEGRATED ELECTROMAGNETIC RADIATION PATHWAYS

(75) Inventors: Travis G. Olson, Seattle, WA (US); Jason P. Bommer, Tacoma, WA (US)

(73) Assignee: The Boeing Company, Chicago, IL (US)

( * ) Notice: Subject to any disclaimer, the term of this patent is extended or adjusted under 35 U.S.C. 154(b) by 256 days.

(21) Appl. No.: 12/277,525

(22) Filed: Nov. 25, 2008

(65) Prior Publication Data

US 2010/0127802 A1 May 27, 2010

(51) Int. Cl.
*H01P 3/12* (2006.01)

(52) U.S. Cl. ..... 333/248; 333/239

(58) Field of Classification Search ..... 333/239, 333/248, 157

See application file for complete search history.

(56) References Cited

U.S. PATENT DOCUMENTS

| | | | | |
|---|---|---|---|---|
| 4,918,411 | A * | 4/1990 | Staehlin et al. | 333/239 |
| 5,185,579 | A * | 2/1993 | Mertens et al. | 324/527 |
| 5,195,162 | A | 3/1993 | Sultan et al. | |
| 5,920,245 | A * | 7/1999 | Ishikawa et al. | 333/248 |
| 6,909,345 | B1 | 6/2005 | Salmela et al. | |
| 6,917,263 | B2 * | 7/2005 | Abe et al. | 333/239 |
| 7,205,956 | B1 | 4/2007 | Sychaleun et al. | |
| 2003/0227360 | A1 * | 12/2003 | Kirihara et al. | 333/239 |
| 2005/0128028 | A1 * | 6/2005 | Sanchez et al. | 333/157 |

FOREIGN PATENT DOCUMENTS

| | | | |
|---|---|---|---|
| EP | 1331688 | A1 | 7/2003 |
| GB | 2269672 | A | 2/1994 |
| WO | WO02/43991 | A1 | 6/2002 |

OTHER PUBLICATIONS

Moisel, J Ed—Institute of Electrical and Electronics Engineers; "Optical Backplane for Avionic Applications using Polymer Multimode Waveguides" Leos 2000 13th Annual Meeting of the IEEE Electro-Opitcs Society. Rio Grande PR, Nov. 13-14, 2000; [Annual Meeting of the IEEE Lasers and Electro-Optics Society] New York, NY : IEEE, U.s. pp. 567-568, XP002448959 ISBN: 978-0-7803-5948-2 p. 567, line 1-line 23.

European Patent Office; International Search Report and Written Opinion for PCT/US2009/062389 filed Oct. 28, 2009; (Seach Report issued Feb. 1, 2010).

Nagesh et al., "Microwave propagation in two dimensional structures using lossy cylindrical glass rods," Eur. Phys. J. B 41, pp. 177-184, (2004).

Nagesh et al., "Two-dimensional microwave band-gap structures of different dielectric materials," Indian Academy of Sciences, vol. 65, No. 6, pp. 1115-1120, (2005).

* cited by examiner

*Primary Examiner* — Benny Lee
(74) *Attorney, Agent, or Firm* — Klintworth & Rozenblat IP LLC

(57) ABSTRACT

A sandwich vehicle structure may allow for confined propagation of electromagnetic radiation within the sandwich vehicle structure. The sandwich vehicle structure may include at least one upper conducting plate, at least one lower conducting plate, and a core extending between the upper and lower conducting plates. The core may comprise a core medium, and a plurality of spaced apart core members embedded in the core medium and extending between the upper and lower conducting plates. The core medium and the core members may allow for the propagation of electromagnetic radiation within the core.

27 Claims, 4 Drawing Sheets

SANDWICH VEHICLE STRUCTURE HAVING INTEGRATED ELECTROMAGNETIC RADIATION PATHWAYS

FIELD

The disclosure relates to sandwich vehicle structures having integrated electromagnetic radiation pathways.

BACKGROUND

It is beneficial to have access to real time vehicle health information regarding the performance of a vehicle, such as an aircraft, through integrated sensor networks. Wired systems exist for these purposes, but these types of systems add weight and cost due to the thousands of wires and interconnects required. Open air wireless systems exist for these purposes, but these types of systems may be inefficient, may require larger than necessary power supplies, may add weight and may contribute to interference and data collisions as the radiation propagates to avionics and unintended transceivers.

An electromagnetic radiation system and/or method of propagating electromagnetic radiation in a controlled manner is needed to decrease one or more problems associated with one or more of the existing electromagnetic radiation systems and/or methods.

SUMMARY OF THE INVENTION

In one aspect of the disclosure, a sandwich vehicle structure is disclosed for confined propagation of electromagnetic radiation within the sandwich vehicle structure. The sandwich vehicle structure may comprise at least one upper conducting plate, at least one lower conducting plate, and a core extending between the upper and lower conducting plates. The core may comprise a core medium, and a plurality of spaced apart core members embedded in the core medium and extending between the upper and lower conducting plates. The core medium and the core members may allow for the propagation of electromagnetic radiation within the core.

In another aspect of the disclosure, a method is disclosed of propagating electromagnetic radiation. In one step, a sandwich vehicle structure may be provided comprising a core extending between upper and lower conducting plates. The core may comprise a plurality of integrated wireless electromagnetic pathways extending within the core. In another step, electromagnetic radiation may be propagated along at least one of the integrated wireless electromagnetic pathways within the core.

In an additional aspect of the disclosure, a vehicle is disclosed comprising a sandwich vehicle structure for confined propagation of electromagnetic radiation within the sandwich vehicle structure. The sandwich vehicle structure may comprise at least one upper conducting plate, at least one lower conducting plate, and a core extending between the upper and lower conducting plates. The core may comprise a core medium, and a plurality of spaced apart core members embedded in the core medium and extending between the upper and lower conducting plates. The core medium and the core members may allow for the propagation of electromagnetic radiation within the core. The vehicle may comprise at least one of an aircraft, a spacecraft, a satellite, a ship, a submarine, a rocket, a missile, a land vehicle, a military vehicle, and an automobile. The sandwich vehicle structure may comprise at least one of an aircraft structure, a fuselage, a wing, an aircraft floor, an interior aircraft component, a leading edge of an aircraft, a spacecraft structure, a satellite structure, a ship structure, a submarine structure, a rocket structure, a missile structure, a land vehicle structure, a military vehicle structure, and an automobile structure.

These and other features, aspects and advantages of the disclosure will become better understood with reference to the following drawings, description and claims.

DETAILED DESCRIPTION OF THE INVENTION

The following detailed description is of the best currently contemplated modes of carrying out the disclosure. The description is not to be taken in a limiting sense, but is made merely for the purpose of illustrating the general principles of the disclosure, since the scope of the disclosure is best defined by the appended claims.

Figure 1:
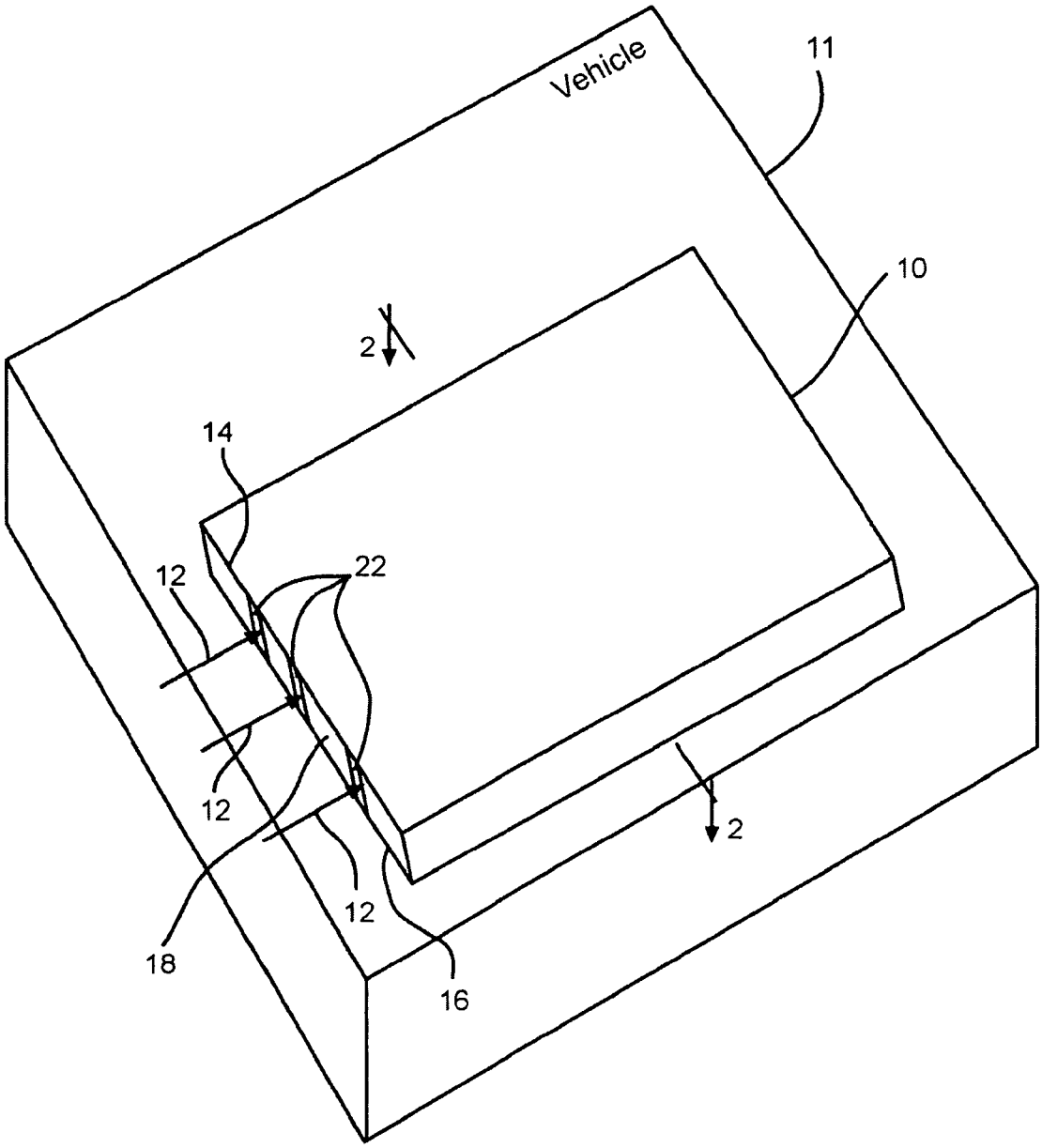
FIG. 1 is a perspective view of an exemplary embodiment of a sandwich vehicle structure of a vehicle for confined propagation of electromagnetic radiation within the sandwich vehicle structure.

FIG. 1 is a perspective view of one embodiment of a sandwich vehicle structure 10 of a vehicle 11 (also shown in FIGS. 2 and 3) for confined propagation of electromagnetic radiation 12 within the sandwich vehicle structure 10. The vehicle 11 may comprise any type of vehicle such as an aircraft, a spacecraft, a satellite, a ship, a submarine, a rocket, a missile, a land vehicle, a military vehicle, an automobile, and/or another type of vehicle. The sandwich vehicle structure 10 may be adapted to propagate electromagnetic radiation 12 wirelessly and may not include any wired power sources, wired data sources, or batteries. The sandwich vehicle structure 10 may comprise: an aircraft structure, such as a fuselage, a wing, an aircraft floor, an interior aircraft component, a leading edge of an aircraft, or another portion of an aircraft; a spacecraft structure; a satellite structure; a ship structure; a submarine structure; a rocket structure; a missile structure; a land vehicle structure; a military vehicle structure; an automobile structure; or another type of vehicle structure.

Figure 2:
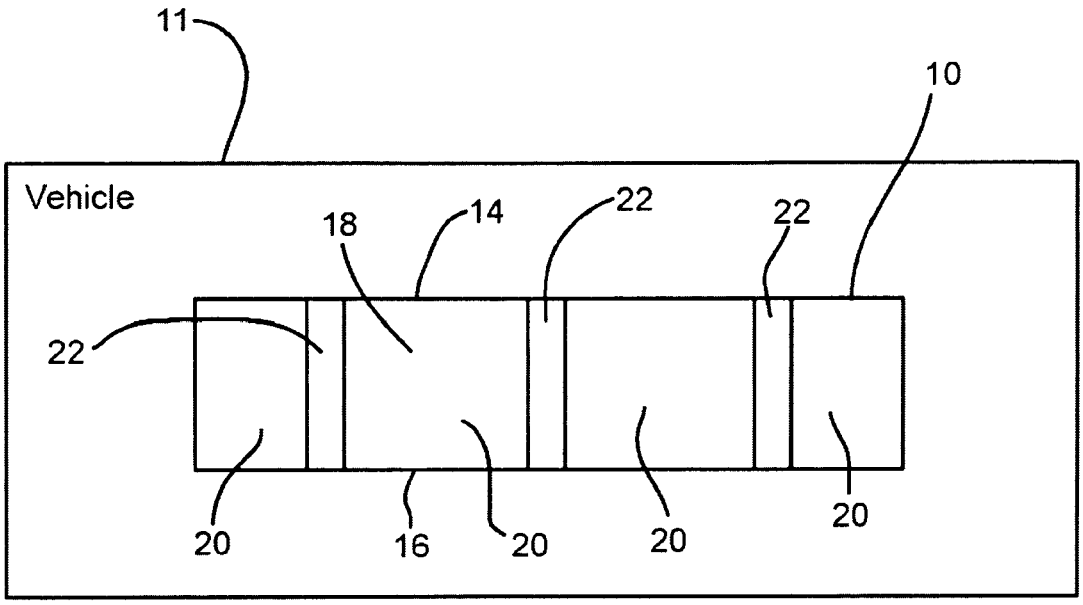
FIG. 2 is a cross-section view through line 2-2 of the embodiment of FIG. 1.
Figure 3:
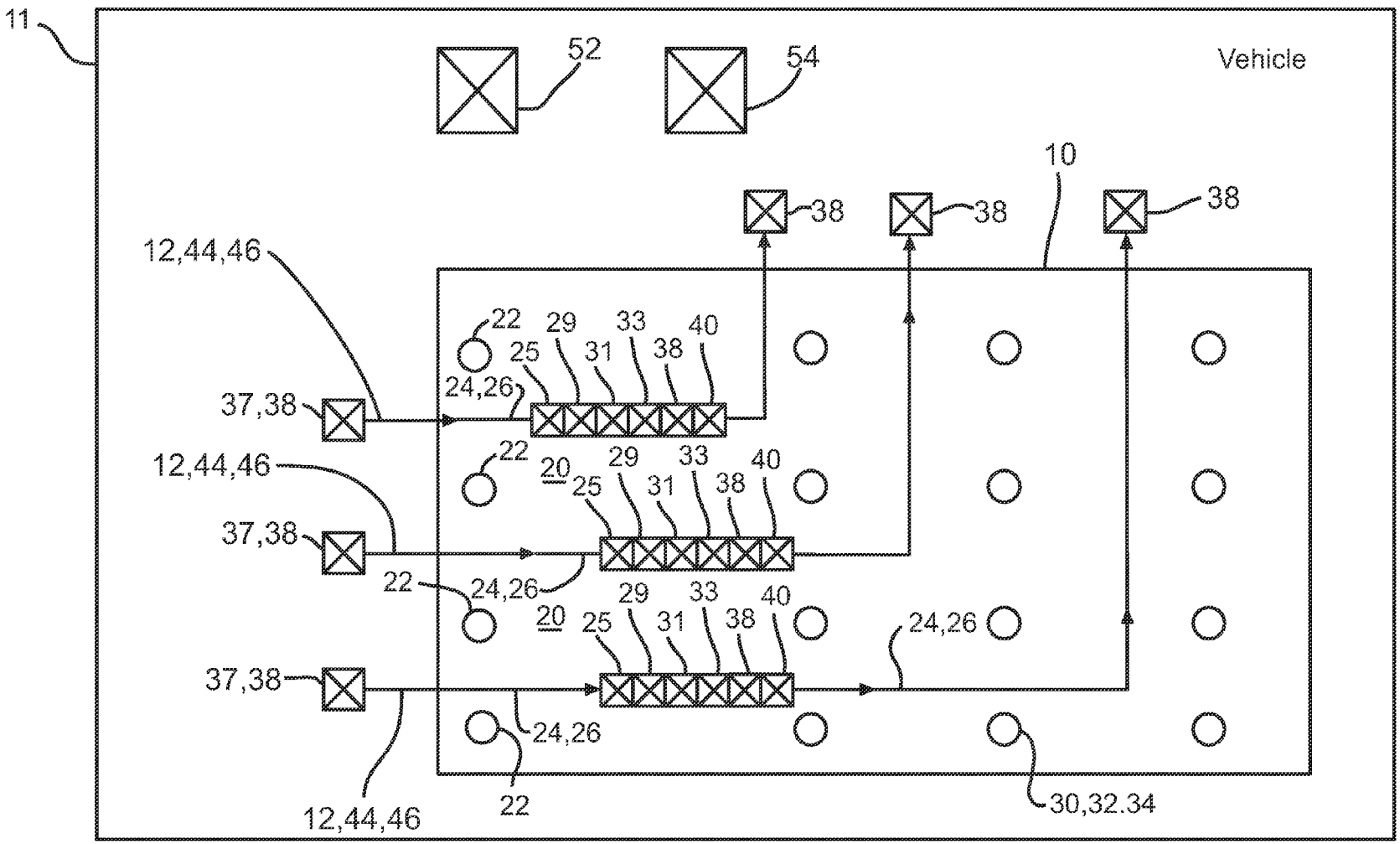
FIG. 3 is a top-view of the embodiment of FIG. 1 with an upper conducting plate removed.

FIG. 2 is a cross-section view through line 2-2 of the embodiment of FIG. 1. As shown in FIGS. 1 and 2, the sandwich vehicle structure 10 may comprise at least one upper conducting plate 14, at least one lower conducting plate 16, and a core 18 extending between the upper and lower conducting plates 14 and 16. FIG. 3 is a top-view of the embodiment of FIG. 1 with the upper conducting plate 14 removed. As used herein, terms such as 'upper' and 'lower' are used to indicate relative positions, and do not require the corresponding apparatus or system to be maintained in a particular configuration or orientation during operation.

As shown in FIGS. 2 and 3, the core 18 may comprise a core medium 20 and a plurality of spaced apart core members 22 (also shown in FIG. 1) embedded in the core medium 20 and extending between the upper and lower conducting plates 14 and 16. The core medium 20 and the core members 22 may each have different electromagnetic properties to allow the propagation of electromagnetic radiation 12 within the core 18. The core medium 20 and the core members 22 may each be made of at least one of a dielectric material, voids (openings) and/or a conductive material. In one embodiment, the core medium 20 may be made of a dielectric material and the core members 22 may be made of a dielectric material having a higher or lower dielectric constant than that of the core medium 20. In another embodiment, the core medium 20 may be made of air or gas and the core members 22 may be made of a dielectric material and/or a conducting material. In still another embodiment, the core medium 20 may be made of a dielectric material and the core members 22 may be made of air or gas surrounded by a conductive material. The core medium 20 may comprise a non-conducting region having a dielectric constant of greater than or equal to 1, and the core members 22 may comprise a conductive material, a non-conductive material having a dielectric constant that is at least one of higher and lower than a dielectric constant of the core medium 20, and/or hybrid materials formed by a combination of conductive and non-conductive materials. In other embodiments, the compositions of the core medium 20 and the core members 22 may vary.

As shown in FIG. 3, the core medium 20 and the core members 22 may each allow for the propagation of electromagnetic radiation 12 along integrated, wireless, electromagnetic pathways 24 which are bound by the core members 22 within the core 18. The electromagnetic pathways 24 may be formed through the core 18. The electromagnetic pathways 24 may be formed by a plurality of the spaced apart core members 22 and the spacing of the spaced apart core members 22 may determine a frequency of propagation of the electromagnetic radiation 12. The directions 26 of the electromagnetic pathways 24 may be arbitrary, and may be determined based upon at least one of the size 30, shape 32, spacing 34, and material properties of the spaced apart core members 22. In such matter, by varying the size 30, shape 32, spacing 34, and material properties of the spaced apart core members 22, varying electromagnetic pathways 24 having differing directions 26 may be formed within and/or through the core 18.

The sandwich vehicle structure 10 may further comprise one or more electromagnetic transceivers 38, electronic devices 29, transducers 31, power units 33, and/or one or more sensors 40 embedded in the core 18. The transceivers, 38 may be adapted to propagate electromagnetic radiation 12 within the core 18 along the electromagnetic pathways 24, and/or to receive and/or transmit data. The electronic devices 29 may be adapted to process and/or interpret at least one of commands, sensor data, and/or other types of information. The sensors 40 may be adapted to detect/sense electromagnetic radiation 12 propagated within the core 18. The transducers 31 may be adapted to sense the physical environment within or external to the core 18. The power units 33 may be adapted to harvest electromagnetic radiation 12 in one or more channels 24 (also referred to throughout this disclosure as electromagnetic pathway 24) of the core 18 and to convert the harvested electromagnetic radiation 12 to usable power for the wireless sensors 40.

The electromagnetic pathways 24 may allow for the propagation within the core 18 of electromagnetic radiation 12 to power the sensors 40 and/or transceivers 38. Electromagnetic radiation 12 may be propagated along at least one of the integrated, wireless, electromagnetic pathways 24 within the core 18 by means of one or more radiating devices 25 comprising an electromagnetic antenna, aperture, probe, and/or other type of radiating devices situated within one or more channels 24 (also referred to throughout this disclosure as electromagnetic pathway 24) of the core 18. One or more computer processing devices 52 and/or one or more display apparatus 54 may be connected to the sensors 40, and/or the transceivers 38. Combining the elements of sensors 40, computer processing devices 52 and display apparatus 54 along with the propagation characteristics of the core may enable a sensor based health management system for any on-board aircraft system. These systems may include wiring, fuels, hydraulic, environmental controls, flight controls, cabin systems or any other existing or emerging system. For structural health monitoring purposes, the transceivers 38 may work in conjunction with the processing devices 52 and display apparatus 54 to define a self-monitoring structural system in order to indicate damage which may have occurred within a particular area of the core 18. The transceivers 38 may be placed along the perimeter of the sandwich structure 10 at either end of the electromagnetic pathway 24 allowing for propagation to take place along any row or column defined by the grid. By activating any of the transceiver pairs the channel 24 (also referred to throughout this disclosure as electromagnetic pathway 24) may be interrogated and a health assessment can be made for the channel 24. This may allow for high spatial resolution assessments at arbitrary locations. The interrogation may be performed with the aid of sensors 40 that have on board processing capability.

In one embodiment, the sandwich vehicle structure 10 may comprise at least one electromagnetic radiation source [[38]] 37 for propagating electromagnetic radiation 12 within the core 18, and at least one transceiver 38 for receiving and/or transmitting electromagnetic radiation 12 propagated within the core 18. The propagated electromagnetic radiation 12 emitted by the electromagnetic radiation source 37 within the core 18 and received and/or transmitted by the transceiver 38 may comprise at least one unmodulated form for power delivery 44 and/or may be modulated with data 46. The electromagnetic radiation 12 propagated within the core 18 may provide power to the transceiver 38 and/or to the sensors 40. Modulated or unmodulated electromagnetic radiation may be used with any two transceivers 38 or sensors 40 to assess the health of the channel 24 (also referred to throughout this disclosure as electromagnetic pathway 24), which also indicates health of the structure 10.

In another embodiment, the sandwich vehicle structure 10 may comprise at least one electromagnetic radiation source [[38]] 37 for propagating electromagnetic radiation 12 within the core 18, and at least one sensor 40 embedded within the core 18 for sensing electromagnetic radiation 12 propagated within the core 18. The propagated electromagnetic radiation 12 emitted by the electromagnetic radiation source [[38]] 37 within the core 18 and sensed/detected by the sensor 40 may be interrogated to detect variations in the electromagnetic radiation 12 indicating damage in one or more areas of the core 18.

Figure 4:
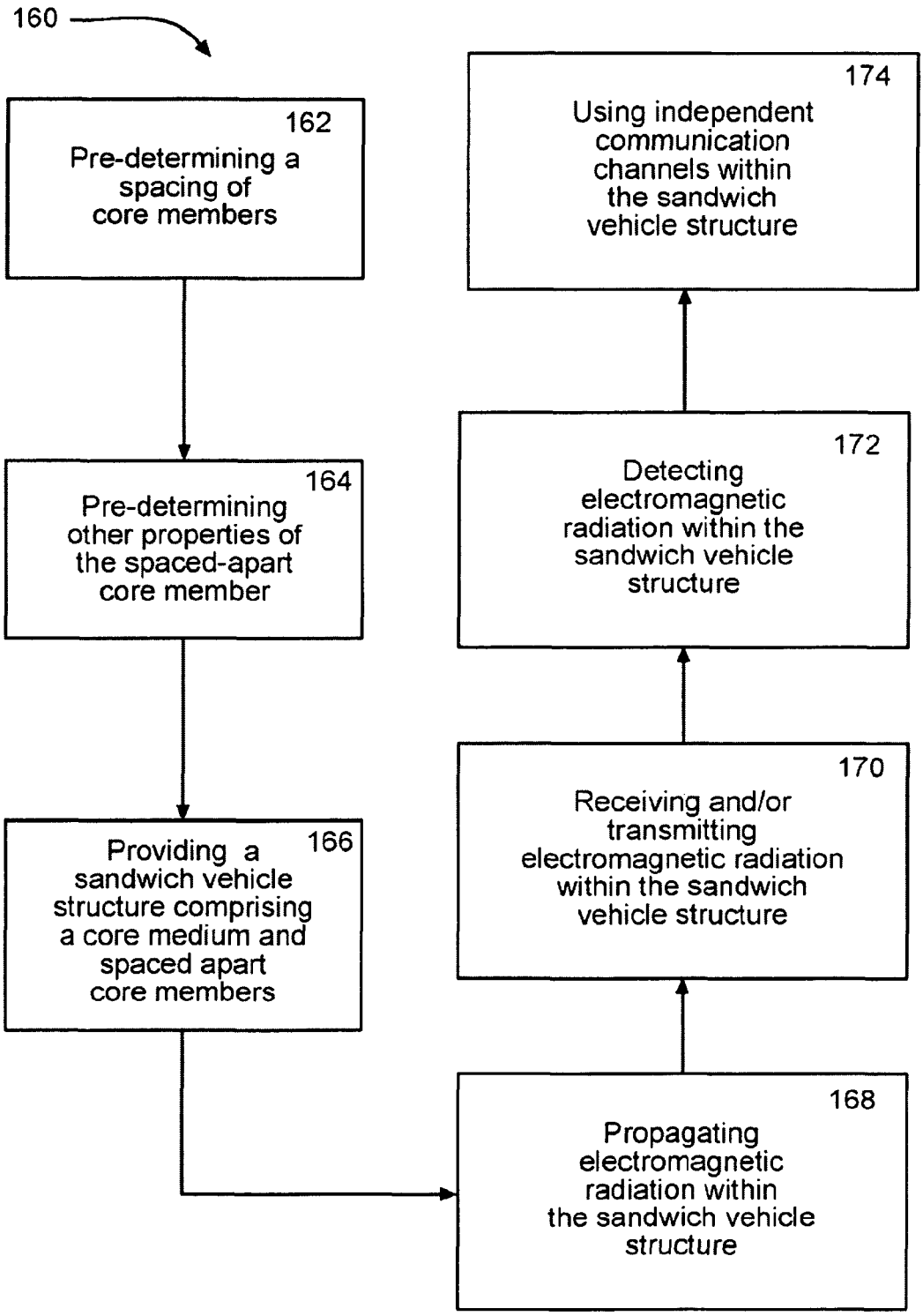
FIG. 4 is a flowchart of one embodiment of a method of propagating electromagnetic radiation. As used herein, the term 'exemplary' refers to an example and not necessarily an ideal.

FIG. 4 is a flowchart of one embodiment of a method 160 of propagating electromagnetic radiation 12. The method may not utilize any wired power sources, wired data sources, and/or batteries. In step 162, a spacing of core members 22 may be pre-determined in order to control the frequency of propagation of electromagnetic radiation 12. In step 164, at least one of a size, a shape, a spacing, and material properties of core members 22 may be pre-determined in order to control directions of electromagnetic pathways 24.

In step 166, a sandwich vehicle structure 10 of a vehicle 11 may be provided comprising a core 18 extending between upper and lower conducting plates 14 and 16. The vehicle 11 may comprise any type of vehicle such as an aircraft, a spacecraft, a satellite, a ship, a submarine, a rocket, a missile, a land vehicle, a military vehicle, an automobile, and/or another type of vehicle. The sandwich vehicle structure 10 may comprise: an aircraft structure, such as a fuselage, a wing, an aircraft floor, interior aircraft components, a leading edge of an aircraft, or another portion of an aircraft; a spacecraft structure; a satellite structure; a ship structure; a submarine structure; a rocket structure; a missile structure; a land vehicle structure; a military vehicle structure; an automobile structure; or another type of vehicle structure. The core 18 may comprise a core medium 20 and a plurality of spaced apart, core members 22 embedded in the core medium 20 extending between the upper and lower conducting plates 14 and 16. The core medium 20 may be made of dielectric material, air, a gas, a conductive material, and/or other types of material and/or gases and the core members 22 may be made of a dielectric material, air, a gas, a conductive material, and/or other types of material and/or gases. The core members 22 may have a higher or lower dielectric constant than a dielectric constant of the core medium 20. The core medium 20 may comprise a non-conducting region having a dielectric constant of greater than or equal to 1, and the core members 22 may comprise a conductive material, a non-conductive material having a dielectric constant that is at least one of higher and lower than a dielectric constant of the core medium 20, and/or hybrid materials formed by a combination of conductive and non-conductive materials. In still other embodiments, the compositions of the core medium 20 and the core members 22 may vary. The core 18 may comprise a plurality of integrated, wireless, electromagnetic pathways 24 extending within and/or through the core 18. The electromagnetic pathways 24 may be formed by a plurality of the spaced apart core members 22.

In step 168, electromagnetic radiation 12 may be propagated along at least one of the integrated, wireless, electromagnetic pathways 24 within the core 18 by means of radiating devices 25 such as an electromagnetic antenna, aperture or probe situated withir a channel 24 (also referred to throughout this disclosure as electromagnetic pathway 24) of the core 18. An electromagnetic radiation source 37 may propagate the electromagnetic radiation 12 along one or more of the electromagnetic pathways 24 within and/or through the core 18. The propagated electromagnetic radiation 12 may be a modulated data carrier. The electromagnetic radiation 12 may also be unmodulated and may provide a source of power to specially designed sensors 40 or transceivers 38 capable of converting the electromagnetic radiation 12 to power the sensors 40 and/or the transceivers 38 using a self-contained or separate power unit 33. The electromagnetic energy may also be used to interrogate the pathway for structural response by analyzing the channel response with the aid of data analysis and processing units on the sensors 40 and/or transceivers 38.

In step 170, electromagnetic radiation 12 propagated within the core 18 may be received and/or transmitted using at least one transceiver 38. The received and/or transmitted propagated electromagnetic radiation 12 may comprise at least one of an unmodulated form/source of power 44, and modulated data 46. In step 172, propagated electromagnetic radiation 12 may be detected within the core 18 using at least one sensor 40 embedded in the core 18 in order to monitor a health of the core 18. In one embodiment, one or more of the electromagnetic pathways 24 within the core 18 may be interrogated with electromagnetic radiation 12 to acquire information regarding the health of the core 18. In step 174, at least one of the pathways 24 within the core 18 may be used as an independent communication channel to at least one of improve performance of wireless communication systems, increase bandwidths and data rates of open-air wireless systems, provide isolation from at least one of ambient interference and jamming sources, provide isolation from an ambient environment to ensure secure communications, and enhance a certification process of wireless systems. In other embodiments, the method 160 may be varied by changing the order of steps 162, 164, 166, 168, 170, 172, and 174, by modifying one or more of the steps, by not following one or more of the steps, and/or by adding one or more additional steps.

One or more embodiments of the disclosure may reduce one or more problems of one or more of the prior art systems and/or methods by allowing for wireless, integrated, arbitrary, electromagnetic pathways throughout a sandwich vehicle structure of a vehicle to provide real-time, high-resolution, wireless health monitoring, wireless communications, and/or wireless power transfer while reducing weight, cost, and/or maintenance.

It should be understood, of course, that the foregoing relates to exemplary embodiments of the disclosure and that modifications may be made without departing from the spirit and scope of the disclosure as set forth in the following claims.

The invention claimed:

1. A sandwich vehicle structure for confined propagation of electromagnetic radiation within the sandwich vehicle structure, the sandwich vehicle structure comprising:

at least one upper conducting plate;

at least one lower conducting plate;

a core extending between the upper and lower conducting plates, the core comprising a core medium and a plurality of spaced apart core members embedded in the core medium and extending between the upper and lower conducting plates;

wherein the core medium and the core members comprise of different electromagnetic properties allowing for propagation of electromagnetic radiation within the core; and at least one of the following disposed within the core: an electronic device for processing or interpreting a command, data, or electronic information; or a power unit for gathering the electromagnetic radiation within the core and for converting the gathered electromagnetic radiation to power.

2. The sandwich vehicle structure of claim 1 wherein the sandwich vehicle structure comprises at least one of an aircraft structure, a fuselage, a wing, an aircraft floor, an interior aircraft component, a leading edge of an aircraft, a spacecraft structure, a satellite structure, a ship structure, a submarine structure, a rocket structure, a missile structure, a land vehicle structure, a military vehicle structure, or an automobile structure.

3. The sandwich vehicle structure of claim 1 wherein a plurality of electromagnetic pathways are formed by a plurality of the spaced apart core members, wherein the spacing of the spaced apart core members determines a frequency of propagation of the electromagnetic radiation.

4. The sandwich vehicle structure of claim 3 wherein directions of the plurality of the electromagnetic pathways within the structure are arbitrary and are determined by at least one of size, shape, spacing, or material properties of the core members.

5. The sandwich vehicle structure of claim 3 wherein the plurality of electromagnetic pathways are formed within the core.

6. The sandwich vehicle structure of claim 1 wherein the core medium comprises a non-conducting region having a dielectric constant of either greater than 1 or equal to 1, and the core members comprise: conductive material; a non-conductive material having a dielectric constant that is higher or lower than a dielectric constant of the core medium; or hybrid materials formed by a combination of conductive and non-conductive materials.

7. The sandwich vehicle structure of claim 1 further comprising a transceiver, disposed within the core, for receiving, transmitting, or propagating the electromagnetic radiation within the core.

8. The sandwich vehicle structure of claim 1 wherein the electromagnetic radiation comprises at least one of a source of power or data.

9. The sandwich vehicle structure of claim 1 further comprising a wireless sensing device comprising:

an antenna embedded in an electromagnetic pathway of the core to couple electromagnetic radiation;

a transceiver to receive and transmit data;

the electronic device to process and interpret at least one of commands or sensor data;

a transducer for sensing a physical environment; and the power unit for gathering electromagnetic radiation in the electromagnetic pathway and for converting the gathered electromagnetic radiation to usable power for the wireless sensing device.

10. The sandwich vehicle structure of claim 1 wherein the sandwich vehicle structure does not comprise any of wired power sources, wired data sources, or batteries.

11. The sandwich vehicle structure of claim 1 comprising the electronic device, disposed within the core, for processing or interpreting at least one of the command, the data, or the electronic information.

12. The sandwich vehicle structure of claim 1 comprising the power unit, disposed within the core, for gathering the electromagnetic radiation within the core and for converting the gathered electromagnetic radiation to the power.

13. A method of propagating electromagnetic radiation comprising:

providing a sandwich vehicle structure comprising a core extending between upper and lower conducting plates, wherein the core comprises a plurality of integrated wireless electromagnetic pathways extending within the core;

propagating electromagnetic radiation along at least one of the electromagnetic pathways within the core; and at least one of: gathering the propagated electromagnetic radiation within the core and converting the gathered electromagnetic radiation to power using a power unit disposed within the core; or processing or interpreting a command, data, or electronic information using an electronic device disposed within the core.

14. The method of claim 13 wherein the sandwich vehicle structure comprises at least one of an aircraft structure, a fuselage, a wing, an aircraft floor, an interior aircraft component, a leading edge of an aircraft, a spacecraft structure, a satellite structure, a ship structure, a submarine structure, a rocket structure, a missile structure, a land vehicle structure, a military vehicle structure, or an automobile structure.

15. The method of claim 13 further comprising the step of:

using the at least one electromagnetic pathway as a wireless independent communication channel to at least one of: provide isolation from at least one of ambient interference or a jamming source; provide isolation from an ambient environment to provide a secure communication; or enhance a certification process of the wireless system.

16. The method of claim 13 further comprising interrogating at least one of the plurality of electromagnetic pathways within the core with the electromagnetic radiation to acquire information regarding a health of the core.

17. The method of claim 13 further comprising wirelessly communicating over at least one of the electromagnetic pathways.

18. The method of claim 13 comprising gathering the propagated electromagnetic radiation within the core and converting the gathered electromagnetic radiation to power using the power unit disposed within the core.

19. The method of claim 13 wherein the propagating the electromagnetic radiation comprises an electromagnetic radiation source propagating the electromagnetic radiation, and further comprising a transceiver disposed within the core for transmitting or receiving the propagated electromagnetic radiation.

20. The method of claim 13 wherein the method does not utilize any wired power sources, wired data sources, or batteries.

21. The method of claim 13 comprising the electronic device, disposed within the core, processing or interpreting the command, the data, or the electronic information.

22. The method of claim 13 wherein the core further comprises a core medium and a plurality of spaced apart core members embedded in the core medium extending between the upper and lower conducting plates.

23. The method of claim 22 wherein the core medium comprises a non-conducting region having a dielectric constant that is either greater than 1 or equal to 1, and the core members comprise conductive material; a non-conductive material having a dielectric constant that is higher or lower than a dielectric constant of the core medium; or hybrid materials formed by a combination of conductive and non-conductive materials,

24. The method of claim 22 further comprising determining a spacing of the spaced apart core members to control a frequency of the propagation of the electromagnetic radiation.

25. The method of claim 22 further comprising determining at least one of size, shape, spacing, or material properties of the spaced apart core members to control directions of the electromagnetic pathways.

26. The method of claim 13 further comprising a transceiver, disposed within the core, receiving, transmitting, or propagating the electromagnetic radiation within the core.

27. A sandwich vehicle structure for confined propagation of electromagnetic radiation within the sandwich vehicle structure, the sandwich vehicle structure comprising:

at least one upper conducting plate;

at least one lower conducting plate;

a core extending between the upper and lower conducting plates, the core comprising a core medium and a plurality of spaced apart core members embedded in the core medium and extending between the upper and lower conducting plates;

wherein the core medium and the core members comprise of different electromagnetic properties allowing for propagation of electromagnetic radiation within the core; and a wireless sensing device comprising: an antenna embedded in an electromagnetic pathway of the core to couple electromagnetic radiation; a transceiver to receive and transmit data; an electronic device to process and interpret at least one of commands or sensor data; a transducer for sensing a physical environment; and a power unit for harvesting electromagnetic radiation in the electromagnetic pathway and for converting the harvested electromagnetic radiation to usable power for the wireless sensing device.

* * * * *